US006247199B1

(12) United States Patent
Petner

(10) Patent No.: US 6,247,199 B1
(45) Date of Patent: Jun. 19, 2001

(54) MOP HEAD CONNECTION

(75) Inventor: Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

(21) Appl. No.: 09/641,404

(22) Filed: Aug. 9, 2000

(51) Int. Cl.[7] ..... A47L 13/20
(52) U.S. Cl. ..... 15/229.1; 15/145; 15/229.2
(58) Field of Search ..... 15/145, 171, 176.1, 15/176.6, 228, 229.1, 229.2, 229.6

(56) References Cited

U.S. PATENT DOCUMENTS 3,682,516 * 8/1972 Savage ..... 15/145
4,642,837 * 2/1987 Nichols et al. ..... 15/145
5,161,278 * 11/1992 Tomm ..... 15/145
5,274,872 * 1/1994 Rich ..... 15/145
5,385,420 * 1/1995 Newman et al. ..... 15/145
6,029,308 * 2/2000 Smith ..... 15/145

* cited by examiner

*Primary Examiner*—Terrence R. Till
(74) *Attorney, Agent, or Firm*—Stuart M. Goldstein

(57) ABSTRACT

A mop head with cleaning strands and a specially configured connector. Internal threading and dual channel openings are inset into the inner wall of the connector. A guide piece is positioned for rotatable movement adjacent to the threaded end of the handle which is to be threadedly engaged to the mop head, by means of the connector. The guide piece comprises two outwardly extending arm members and is held in position at the threaded end by a locking tab. The arm members are inserted into the channel openings as the connector is threaded into the threaded end of the handle. The rotational aspect of the guide piece permits continued screwing of the connector onto the handle's threaded end. However, the placement of the guide piece on the threaded end will not permit a mop head connector which is not configured with the dual channel openings from being threaded onto the handle.

24 Claims, 3 Drawing Sheets

MOP HEAD CONNECTION

BACKGROUND OF THE INVENTION

The cleaning section of a mop, normally referred to as the mop head, is routinely secured to the mop's handle by a threaded connection, i.e. threads at the end of the handle are screwed into a threaded opening in the mop head. In this manner, mop heads whose cleaning strands become old and ineffective can be discarded and new heads replaced on the mop handles.

However, a mop manufacturer or distributor who seeks to ensure that the replacement mop head which is used on its mop product is the proper head and one which is specifically designed for that product, has no viable means of preventing the use of other brands of mop heads. Standard ¾ inch or ⅞ inch threaded connections permit the engagement of any mop head onto a corresponding mop handle. There currently is no viable, effective, and practical means to ensure that only the designated mop heads, specially designed for given mop units, are used to the exclusion of other heads.

SUMMARY OF THE INVENTION

Accordingly it is the object of the present invention to overcome the limitations and deficiencies of prior mop head connectors.

It is the object of the present invention to provide a mop head connection system which will allow the use and replacement of mop heads only on mops which are configured in accordance with the invention.

It is a further object of the present invention to provide a mop head connection system which will not permit, but will preclude the use and replacement of mop heads on mops which are not configured in accordance with the invention.

It is another object of the invention to provide a mop head connection system which employs guide piece/mop head connector components specially configured to be used for threaded engagement only on those mops configured in accordance with the invention.

It is still another object of the invention to provide a mop head connection system which is simple and economical to produce and which requires limited extra components.

It is a further object of the present invention to provide a mop head connection system which can easily and efficiently be assembled to a designated mop handle.

The present invention comprises a mop head with cleaning strands and a specially configured connector. Internal threading and dual channel openings are inset into the inner wall of the connector. A guide piece is positioned for rotatable movement adjacent to the threaded end of the handle which is to be threadedly engaged to the mop head, by means of the connector. The guide piece comprises two outwardly extending arm members and is held in position at the threaded end by a locking tab. The arm members are inserted into the channel openings as the connector is threaded into the threaded end of the handle. The rotational aspect of the guide piece permits continued screwing of the connector onto the handle's threaded end. However, the placement of the guide piece on the threaded end will not permit a mop head connector which is not configured with the dual channel openings from being used on the handle.

The novel features which are considered as characteristic of the invention are set forth in particular in the appended claims. The invention, itself, both as to its design, construction, and use, together with additional features and advantages thereof, are best understood upon review of the following detailed description with reference to the accompanying drawings.

DETAILED DESCRIPTION OF THE DRAWINGS

Figure 5:
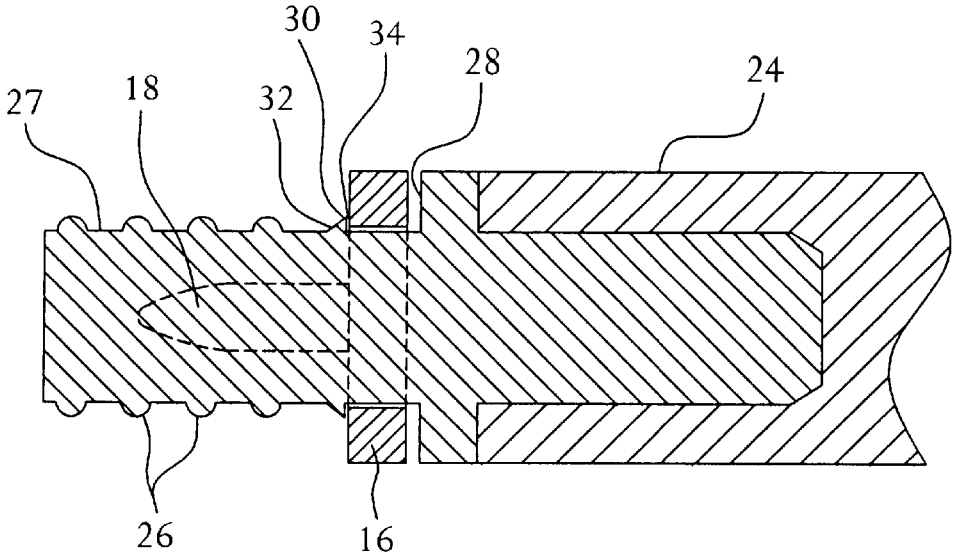
FIG. 5 is a cross-sectional view taken from FIG. 4.

Mop head 2 of the present invention comprises cloth strands 4 secured in conventional fashion to mop head connector piece 6. Connector 6 comprises internal threads 8 and channel openings 10 and 12 inset within its inner wall surface. Guide piece 14 consists of a circular base 16 and outwardly extending members 18 and 20, which are configured for insertion into openings 10 and 12 respectively. Guide piece 14 is configured to be slid over the threaded end 22 of mop handle 24. Threaded end 22 comprises threads 26 upstanding from threaded end surface 27. Threads 26 and configured for threaded engagement with internal threads 8 of connector 6. Threaded end 22 also comprises lip area 28 and locking tab 30. As can be best seen in FIG. 5, the outer surface 32 of tab 30 is slanted towards the handle and its inner surface 34 is perpendicular to threaded end surface 27.

In order to assemble mop head 2 and handle 24, guide piece 14 is slid over threaded end 22. Guide piece 14 slides over outer surface 32 of tab 30 and continues until it reaches lip area 28 of threaded end 22, which stops any further movement. Inner surface 34 of tab 30 keeps guide piece from moving out of this position. However, the internal diameter of base 16 of guide piece 14 is configured to be larger than the diameter of threaded end 22 so, when guide piece 14 is in position between lip 28 and tab 30, members 18 and 20 are configured to be positioned over and above threads 26. This arrangement allows guide piece 14 to rotate freely around threaded end surface 27.

Figure 1:
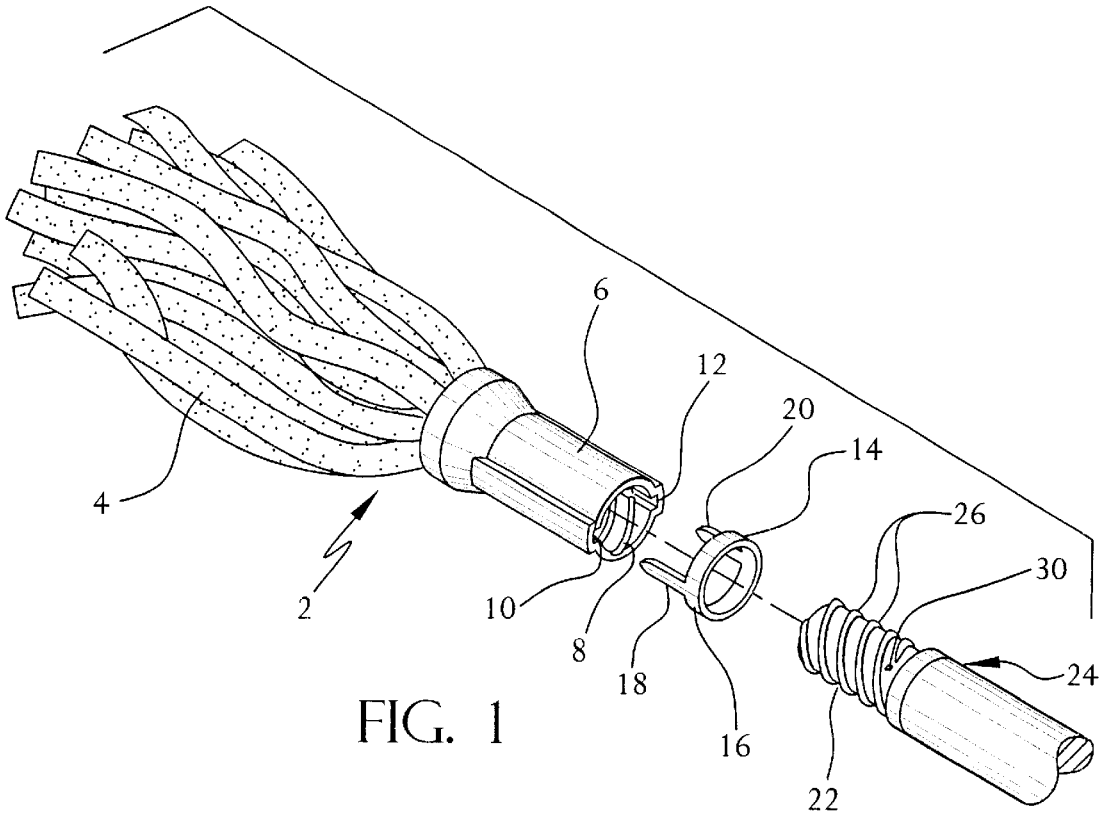
FIG. 1 is an exploded view showing the mop head connection system of the present invention.
Figure 2:
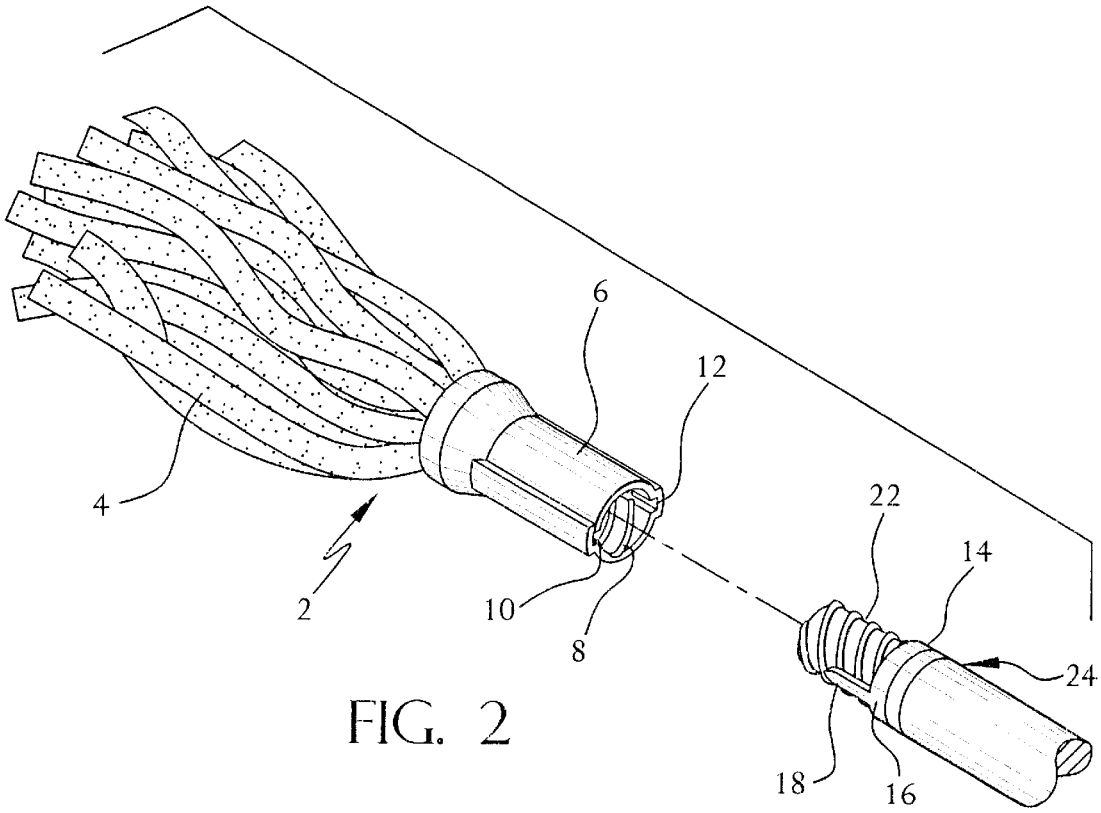
FIG. 2 is an exploded view showing the partial assembly of the mop head system of the invention.
Figure 3:
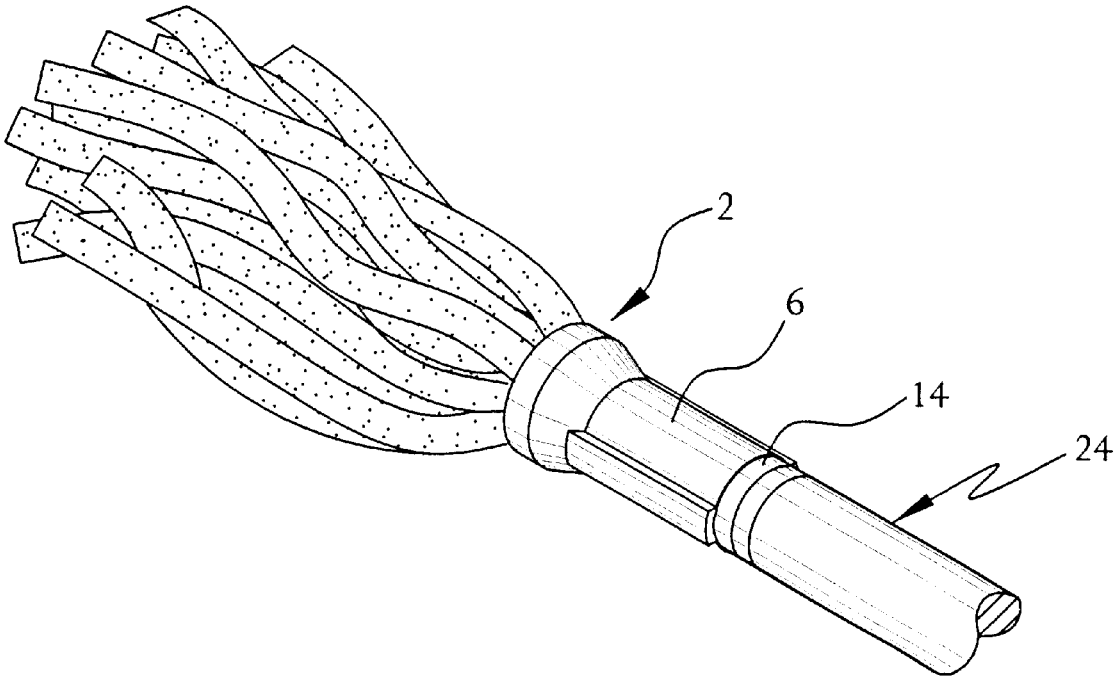
FIG. 3 is a view of the assembled mop head and handle.
Figure 4:
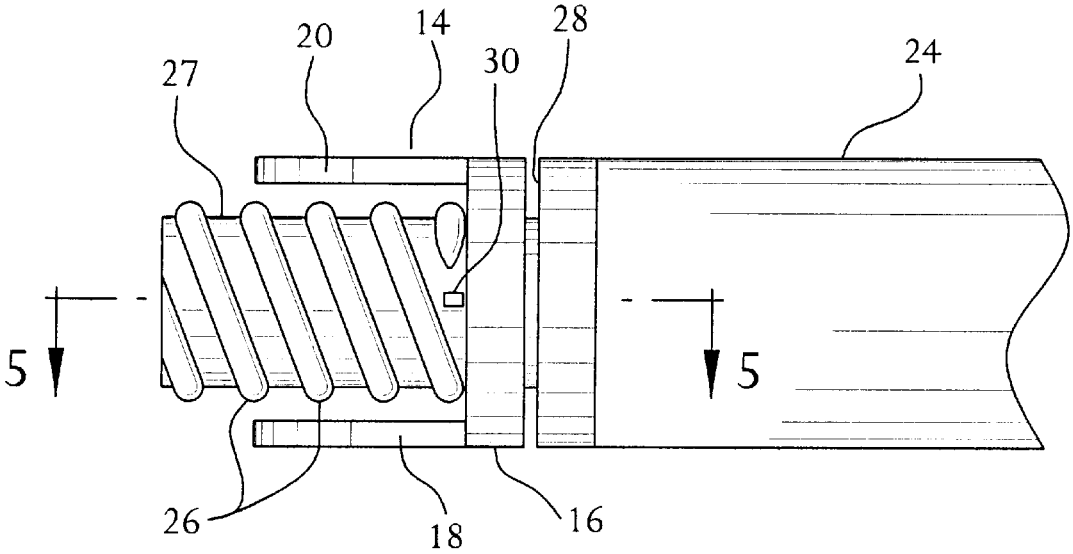
FIG. 4 is an elevation view of the threaded end of the handle, with the guide piece installed in position.

Mop head 2 is connected for threaded engagement with the handle, by screwing internal threads 8 onto threaded end 22. As connector 6 is turned onto threaded end 22, it reaches guide piece 14, where members 18 and 20 are aligned for insertion into openings 10 and 12 respectively. The rotatable aspect of guide piece 14 allows connector 6 and threaded end 22 to continue being threaded together as members 18 and 20 enter openings 10 and 12. Members 18 and 20 move further and further into openings 10 and 12 as the process continues, until mop head 2 is fully threaded and tightened onto handle 24, as shown in FIG. 3.

The resulting mop connection system will ensure that only designated mop heads, that is mop heads configured with connectors such as described herein, be used on corresponding mops.

Certain novel feature and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed is:

1. A mop head connection system for securing a mop head with cleaning strands to a mop handle with a threaded end, said system comprising:

(a) separable guide means rotatably mounted adjacent to the threaded end of the mop handle, said guide means extending over a portion of the threaded end of the handle;

(b) mop head connector means secured at one end to the cleaning strands, said connector means having a second end configured for threaded engagement with the threaded end of the mop handle and further comprising opening means for insertion of the guide means, whereby when the connector means and the threaded end of the mop handle are engaged, the guide means are positioned within the opening means.

2. The mop head connection system as in claim 1 in which the guide means comprises outwardly extending members.

3. The mop head connection system as in claim 1 in which the opening means comprises channels inset within inner walls of the connector means.

4. The mop head connection system as in claim 1 in which the connector means comprises internal threads which correspond to the threaded end of the mop handle.

5. The mop head connection system as in claim 4 in which the members are positioned in the channels when the connector is in threaded engagement with the threaded end of the mop handle.

6. The mop head connection system as in claim 1 further comprising locking means for securing the guide means in place and for allowing rotatable movement of the guide means at the threaded end of the handle.

7. The mop head connection system as in claim 6 in which the locking means comprises a lock tab on the handle.

8. The mop head connection system as in claim 1 in which the guide means comprises a base which circumvents the handle and members outwardly extending from the base.

9. The mop head connection system as in claim 8 in which the members are insertable into the opening means when the connector means is engagement with the threaded end of the mop handle.

10. The mop head connection system as in claim 9 in which the opening means comprises channels inset within inner walls of the connector means.

11. The mop head connection system as in claim 1 in which said guide means comprises members extending over a portion of the threaded end of the handle.

12. A mop head connection system comprising:

(a) a handle with a threaded end;

(b) mop head connector means for threaded engagement with the threaded end, said connector means comprising internal channel openings; and (c) separable guide means positioned on and rotatably moveable around the threaded end of the handle, said guide means being positioned in the openings when the connector means is in threaded engagement with the threaded end of the handle.

13. A mop head connection system as in claim 12 in which the guide means comprise outwardly extending members.

14. The mop head connection system as in claim 12 in which the channel openings are inset within inner walls of the connector means.

15. The mop head connection system as in claim 12 further comprising locking means for securing the guide means in place for rotatable movement at the threaded end of the handle.

16. The mop head connection system as in claim 15 in which the locking means comprises a lock tab on the handle.

17. The mop head connection system as in claim 12 in which the guide means comprises a base which circumvents the handle and members outwardly extending from the base.

18. The mop head connection system as in claim 17 in which the members are insertable into the openings when the connector means is in threaded engagement with the threaded end of the handle.

19. A mop head connection comprising:

(a) a handle with a threaded end;

(b) a mop head connector comprising an inner wall surface with internal thread means for engagement with the threaded end, said inner wall surface comprising channel openings;

(c) separable guide means positioned on and rotatably movable around the threaded end, said guide means extending over a portion of the threaded end of the handle and being configured for insertion into the openings, whereby the guide means at all times remain in the openings as the connector is screwed onto the threaded end.

20. The mop head connection as in claim 19 in which the guide means comprises outwardly extending members configured for insertion within the openings.

21. The mop head connection as in claim 19 further comprising locking means for securing the guide means in place for rotatable movement at the threaded end of the handle.

22. The mop head connection as in claim 21 in which the locking means comprises a lock tab on the handle.

23. The mop head connection as in claim 19 in which the guide means further comprises a base which circumvents the handle, the members being outwardly extending from the base.

24. The mop head connection as in claim 19 in which there are two channel openings located within the connector.

* * * * *